US009553397B2

(12) United States Patent
Eom et al.

(10) Patent No.: US 9,553,397 B2
(45) Date of Patent: Jan. 24, 2017

(54) ELECTRIC CONNECTOR AND HOUSING HAVING A SIMPLE MOUNTING STRUCTURE

(71) Applicant: LSIS CO., LTD., Anyang-si, Gyeonggi-do (KR)

(72) Inventors: Jun Seok Eom, Gunpo-si (KR); Kyoo Seok Kim, Suwon-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/852,091

(22) Filed: Sep. 11, 2015

(65) Prior Publication Data

US 2016/0087371 A1 Mar. 24, 2016

(30) Foreign Application Priority Data

Sep. 18, 2014 (KR) ..... 20-2014-0006794 U

(51) Int. Cl.

| | |
|---|---|
| ***H01R 13/73*** | (2006.01) |
| ***H01R 13/52*** | (2006.01) |
| ***H01R 4/34*** | (2006.01) |
| ***H01R 9/18*** | (2006.01) |
| ***H01R 13/405*** | (2006.01) |
| ***H01R 31/06*** | (2006.01) |

(52) U.S. Cl.

CPC ..... *H01R 13/5205* (2013.01); *H01R 4/34* (2013.01); *H01R 9/18* (2013.01); *H01R 13/405* (2013.01); *H01R 13/5202* (2013.01); *H01R 31/06* (2013.01)

(58) Field of Classification Search

CPC ..... H01R 13/5202; H01R 13/5219; H01R 13/6584

USPC ..... 439/559, 926, 801; 174/158 G

See application file for complete search history.

(56) References Cited

U.S. PATENT DOCUMENTS

| | | | | |
|---|---|---|---|---|
| 2,579,973 A * | 12/1951 | Schlosser | H01B 17/306 | 174/151 |
| 5,227,587 A * | 7/1993 | Paterek | H01B 17/305 | 174/151 |
| 8,647,159 B2 * | 2/2014 | Steeves | H01R 4/305 | 439/798 |

(Continued)

FOREIGN PATENT DOCUMENTS

| | | |
|---|---|---|
| JP | 5918386 | 2/1984 |
| JP | 2000133370 | 5/2000 |

(Continued)

OTHER PUBLICATIONS

European Patent Office Application Serial No. 15185444.5, Search Report dated Nov. 20, 2015, 8 pages.

(Continued)

*Primary Examiner* — Phuong Dinh

(74) *Attorney, Agent, or Firm* — Lee, Hong, Degerman, Kang & Waimey PC

(57) ABSTRACT

Provided is an electric connector for connecting electric equipment to a power device. The electric connector includes a connector body defining an outer appearance thereof, a connection bar disposed on the connector body to electrically the connect electric equipment to the power device, an insertion part disposed on the connector body, the insertion part being inserted into the electric equipment, and a sealing disposed on a shaft of the insertion part in a circumferential direction.

3 Claims, 5 Drawing Sheets

(56) References Cited

U.S. PATENT DOCUMENTS

| | | | | |
|---|---|---|---|---|
| 8,794,999 | B2 * | 8/2014 | Schuckmann | H01R 13/44 439/587 |
| 2008/0268695 | A1 | 10/2008 | Dieterie et al. | |

FOREIGN PATENT DOCUMENTS

| | | |
|---|---|---|
| JP | 2010525547 | 7/2010 |
| JP | 2011-029021 | 2/2011 |
| JP | 2011-108633 | 6/2011 |
| JP | 2013045510 | 3/2013 |
| JP | 2014-127429 | 7/2014 |
| JP | 2014-220045 | 11/2014 |

OTHER PUBLICATIONS

Japan Patent Office Application No. 2015-185012, Office Action dated Jul. 19, 2016, 3 pages.

* cited by examiner

ELECTRIC CONNECTOR AND HOUSING HAVING A SIMPLE MOUNTING STRUCTURE

CROSS-REFERENCE TO RELATED APPLICATIONS

Pursuant to 35 U.S.C. §119(a), this application claims the benefit of earlier filing date and right of priority to Korean Patent Application No. 20-2014-0006794, filed on Sep. 18, 2014, the contents of which are all hereby incorporated by reference herein in its entirety.

BACKGROUND

The present disclosure relates to an electric connector for an electric vehicle.

Electric vehicles mean vehicles driven by using electricity. Electric vehicles may be largely classified into battery powered electric vehicles and hybrid electric vehicles. Here, the battery powered electric vehicles mean vehicles driven by using only electricity without using fossil fuel. Thus, such a battery powered electric vehicle may be generally called an electric vehicle. Also, the hybrid electric vehicles mean vehicles driven by using electricity and fossil fuel. Such a hybrid electric vehicle includes a battery that supplies electricity for driving. Particularly, in a case of the battery power electric vehicle and a plug-in type hybrid electric vehicle of the hybrid electric vehicle, a battery is charged by using power supplied from an external power source to drive an electric motor by using the power charged in the battery.

A power control device for the electric vehicle includes a connector for electrically connecting the electric vehicle to an external device. The connector has to supply an electrically connecting function and a sealing function between the inside and outside of a product. An existing connector may be coupled from the outside by using a bolt and fixed to an enclosure of the product to provide the sealing function.

SUMMARY

Embodiments provide an electric connector that is applied to a power conversion device for an electric vehicle and has a simple mounting structure to reduce assembly costs.

Embodiments also provide an electric connector that provides a simple mounting structure and a stable sealing function.

In one embodiment, electric connector includes: a connector body defining an outer appearance thereof; a connection bar disposed on the connector body to electrically connect electric equipment to a power device; an insertion part disposed on the connector body, the insertion part being inserted into the electric equipment; and a sealing disposed on a shaft of the insertion part in a circumferential direction.

The insertion part may include a first shaft and a second shaft which have diameters different from each other.

The insertion part may have one of a circular shape or a rectangular shape with a rounded edge.

The electric connector may include the insertion part having the circular shape comprises a rotation preventing protrusion on an upper end of the connection bar.

A difference between the diameters of the shaft of the insertion part and the insertion groove of the electric equipment may be a tolerance value due to press fitting.

The electric connector may further include: a housing connection part disposed on one end of the connection bar; and a power device connection part disposed on the other end of the connection bar.

The power device connection part may have at least one of a nut shape or a stud shape.

The insertion part may include a sealing having a ring shape along a circumferential direction on the shaft thereof.

The sealing may be disposed on a portion that contacts the housing first when the insertion part is inserted into the housing.

The details of one or more embodiments are set forth in the accompanying drawings and the description below. Other features will be apparent from the description and drawings, and from the claims.

DETAILED DESCRIPTION OF THE EMBODIMENTS

Hereinafter, embodiments of the present disclosure will be described in more detail with reference to the accompanying drawings. Furthermore, terms, such as a "module" ad a "unit", are used for convenience of description, and they do not have different meanings or functions in themselves.

Hereinafter, an electric connector that is inserted into electric equipment according to an embodiment to electrically connect the electric equipment to a power device will be described in more detail with reference to the accompanying drawings. An electric vehicle will be described as an example of the electric equipment. However, the present disclosure is not limited to the electric vehicle. For example, the present disclosure may be applied to a device using the other electric connector.

Figure 1:
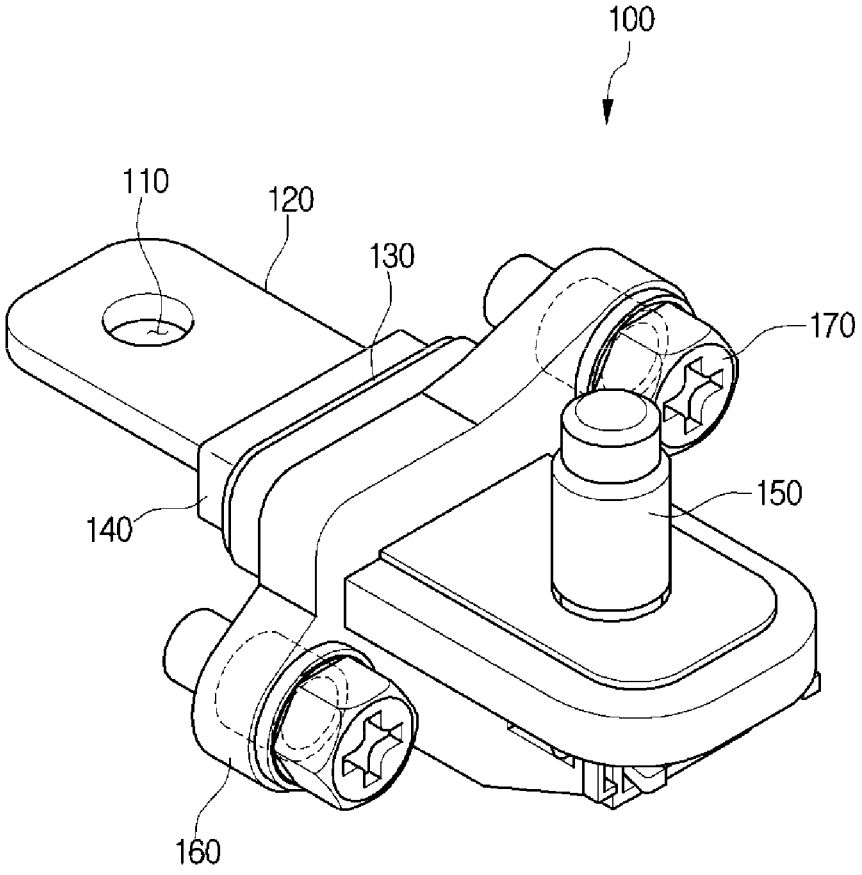
FIG. 1 Prior Art
FIG. 1 is a view illustrating a structure of an electric connector 100 connecting an electric vehicle to a power device according to a related art.

FIG. 1 is a view illustrating a structure of an electric connector 100 connecting an electric vehicle to a power device according to a related art.

Referring to FIG. 1, the electric connector 100 according to the related art includes a housing connection part 110, a connection bar 120, a sealing 130, an insertion part 140, a power device connection part 150, a bolt connection part 160, and a connector installing bolt 170.

Detailed descriptions with respect to the housing connection part 110, the connection bar 120, the sealing 130, the insertion part 140, and the power device connection part 150 will be described with reference to FIG. 2. Here, the bolt connection part 160 and the connection installing bolt 170 which cause limitations in the related art will be mainly described.

The electric connector 100 according to the related art includes the bolt connection part 160 and the connector installing bolt 170 which are configured to fix the electric connector 100 to the electric vehicle.

The bolt connection part 160 inserts the connector installing bolt 170 therein to fix the electric vehicle. Particularly, the bolt connection part 160 is coupled to the connector installing bolt 170 to fix the electric connector 100 to a housing of the electric vehicle while providing a space into which the connector installing bolt 170 is inserted. A pair of bolt connection parts 160 may be provided on left and right sides of the electric connector 100. The bolt connection part 160 may include a screw protrusion into which the connector installing bolt 170 is insertable.

The connector installing bolt 170 fixes the electric connector 100 to the housing of the electric vehicle. Particularly, the connector installing bolt 170 is inserted into the bolt connection part 160 of the electric connector 100 and then inserted into the housing of the electric vehicle to fix the electric connector 100 to the housing.

Although the fixing of the electric connector 100 by using the above-described bolt connection part 160 and connection installing bolt 170 is intuitionally and easily realized, the manufacturing process may be complicated in that the bolt connection part 160 has to be additionally formed. Also, since the manufacturing process is complicated, manufacturing costs may increase. Furthermore, since the connector installing bolt 170 is necessarily provided, the manufacturing costs may further increase.

Also, the manufacturing process may be complicated in that a portion into which the connector installing bolt 170 has to be formed in the housing of the electric vehicle. As a result, the manufacturing costs may increase.

Thus, an electric connector in which the bolt connection part 160 and the connector installing bolt 170 are omitted to simplify the manufacturing process and reduce the manufacturing costs while being sufficiently fixed will be described below.

Figure 2:
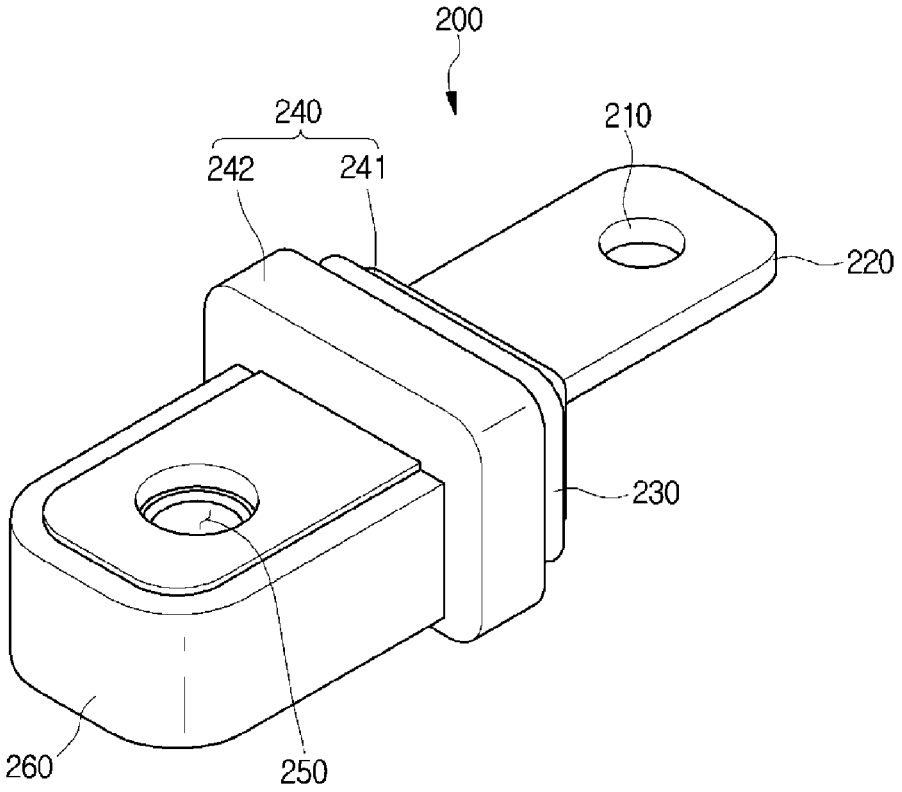
FIGS. 2 and 3 are views of an electric connector 200 according to an embodiment.
Figure 3:
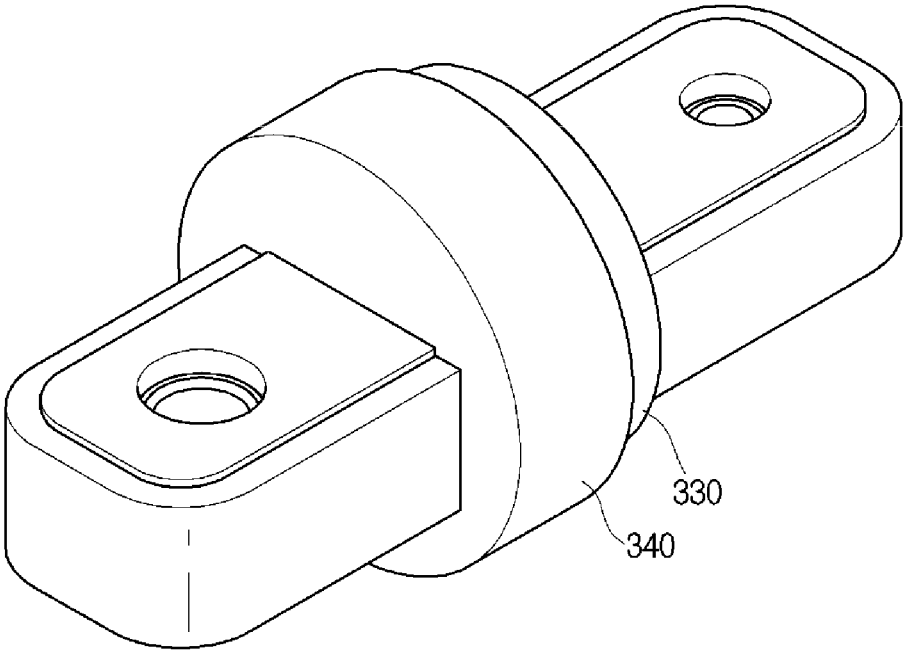

FIGS. 2 and 3 are views of an electric connector 200 according to an embodiment.

Referring to FIG. 2, the electric connector 200 according to an embodiment includes a first housing connection part 210, a connection bar 220, a sealing 230, an insertion part 240, a power device connection part 250, and a connector body 260.

Before description of each of the constituents, use of the electric connector 200 according to the current embodiment will be described. The electric connector 200 according to the current embodiment may be an apparatus for connecting electric equipment including the electric vehicle to a power device (for example, a converter or inverter). Thus, a structure in which the electric vehicle or power device is connected to both ends of the electric connector may be provided. Also, the electric connector according to the current embodiment may include a connection bar for transmitting electric energy as a device for connecting the electric vehicle to the power device. Hereinafter, each of the constituents will be described.

The first housing connection part 210 may be a portion at which a housing of the electric vehicle is connected to the electric connector 200. The first housing connection part 210 may be provided in a hole shape that vertically passes through the connection bar 220. The housing of the electric vehicle and the electric connector 200 may be connected to each other via a bolt inserted into the first housing connection part 210.

The connection bar 220 electrically connects the power device to the electric vehicle. The connection bar 220 may be manufactured in a plate shape that is formed of a conductive material. The connection bar 220 may be positioned at a first end of the connector body 260. The connection bar 220 has one end on which the power device connection part 250 is disposed and the other end on which the first housing connection part 210 is disposed. The connection bar 220 receives the electric energy from the power device connection part 250 to transmit the electric energy to the electric vehicle through the first housing connection part 210.

The sealing 230 may be provided in a ring shape along a circumferential direction on a shaft 241 of the insertion part. For example, FIG. 3 shows sealing 330 in a ring shape. The sealing 230 may be formed of a deformable material. For example, the sealing 230 may be formed of a rubber material. The sealing 230 may be provided in a ring shape on a portion thereof that contacts housing first when the electric connector 200 is inserted into the housing. The sealing 230 may be formed of the deformable material and thus be closely attached to the housing of the electric connector 200.

Particularly, when the electric connector 200 is inserted into the housing, a gap may occur between surfaces of the materials that contact each other. Here, the sealing 230 may change in shape to match the gap so that the electric connector 200 is closely attached to the housing. Also, the sealing 230 may minimize the gap between the electric connector 200 and the housing of the electric vehicle to perform protection against dusts or watertightness.

The insertion part 240 may be a portion for inserting the electric connector 200 into the housing. Although the housing and the electric connector 200 are fixed to each other by using the bolt in the related art, the insertion part 240 may be replaced with the bolt in the current embodiment. Furthermore, since the insertion part 240 is disposed on the connection body 260 to extend, it is unnecessary to provide a separate connection part. Thus, the manufacturing costs and the manufacturing process may be reduced.

In an embodiment, the insertion part 240 may have a rectangular shape with a rounded edge as illustrated in FIG. 2. In another embodiment, the insertion part 340 may have a circular shape as illustrated in FIG. 3.

In case of the insertion part 340 having the circular shape, an electric connector insertion space may be more easily formed in the housing when compared to the insertion part 240 having the rectangular shape. Particularly, in case of the insertion part 240 having the rectangular shape, a groove having the same shape has to be formed in the housing. However, it is difficult to perform a process for forming the rectangular shape in which only the edge is rounded.

Thus, although all of the insertion part of FIG. 2 and the insertion part of FIG. 3 are allowable, the insertion part 340 having the circular shape as illustrated in FIG. 3 may be more advantageous for convenience of the manufacturing.

A rotation preventing protrusion (not shown) may be disposed on an upper end of the connection bar 220. The rotation preventing protrusion may be provided as a protrusion on the upper end of the connection part 220 to prevent the electric connector 200 from undesirably rotating. Particularly, in case of the insertion part 340 having the circular shape, the electric connector 200 may be rotatable, unlike the insertion part 240 having the rectangular shape. In this case, the inner connection may be disconnected. For this, the rotation preventing protrusion may be disposed on the upper end of the connection bar 220 to prevent the electric connector 200 from rotating. A groove having the same shape as the insertion part 240 may be defined in the housing of the electric vehicle. Thus, the insertion part 240 may be inserted into the housing to fix the electric connector 200 to the electric vehicle. The specific fixed structure will be described with reference to FIGS. 4 and 5.

The power device connection part 250 may be disposed on an end of the connection bar 220 to connect the power device to the electric connector 200. In an embodiment, the power device connection part 250 may have a net shape as illustrated in FIG. 2. In this case, a bolt for connecting the power device connection part 250 may be provided on the power device. In another embodiment, the power device connection part 250 may have a stud shape. In this case, a ring formed from the power device may be fitted into the power device connection part 250 having the stud shape to connect the power device to the electric connector 200.

The connector body 260 may define an outer appearance of the electric connector 200. The connection bar 220 having a plate shape may be disposed on an upper end of the connector body 260. The insertion part 240 may be defined in the connector body 260 to extend. The power device connection part 250 may be provided on the connector body 260.

Hereinafter, a coupling relationship between the electric connector 200 and the housing 1 will be described in detail with reference to FIGS. 4 and 5.

Figure 4:
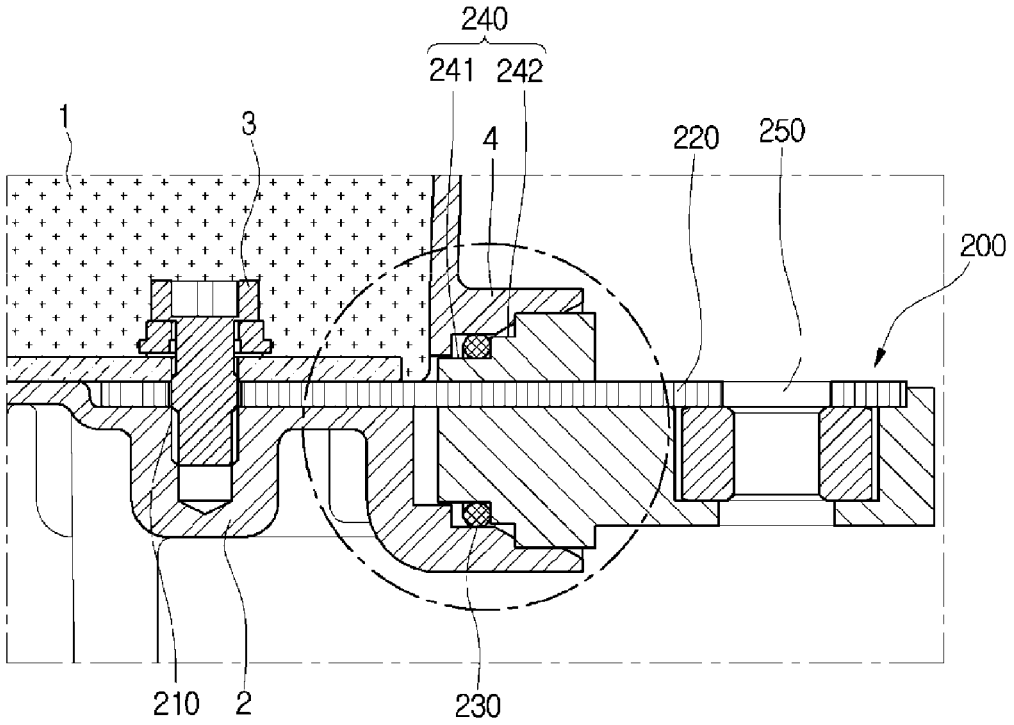
FIG. 4 is a cross-sectional view illustrating an overall coupling relationship between the electric connector 200 and a housing 1.

FIG. 4 is a cross-sectional view illustrating an overall coupling relationship between the electric connector 200 and the housing 1.

Figure 5:
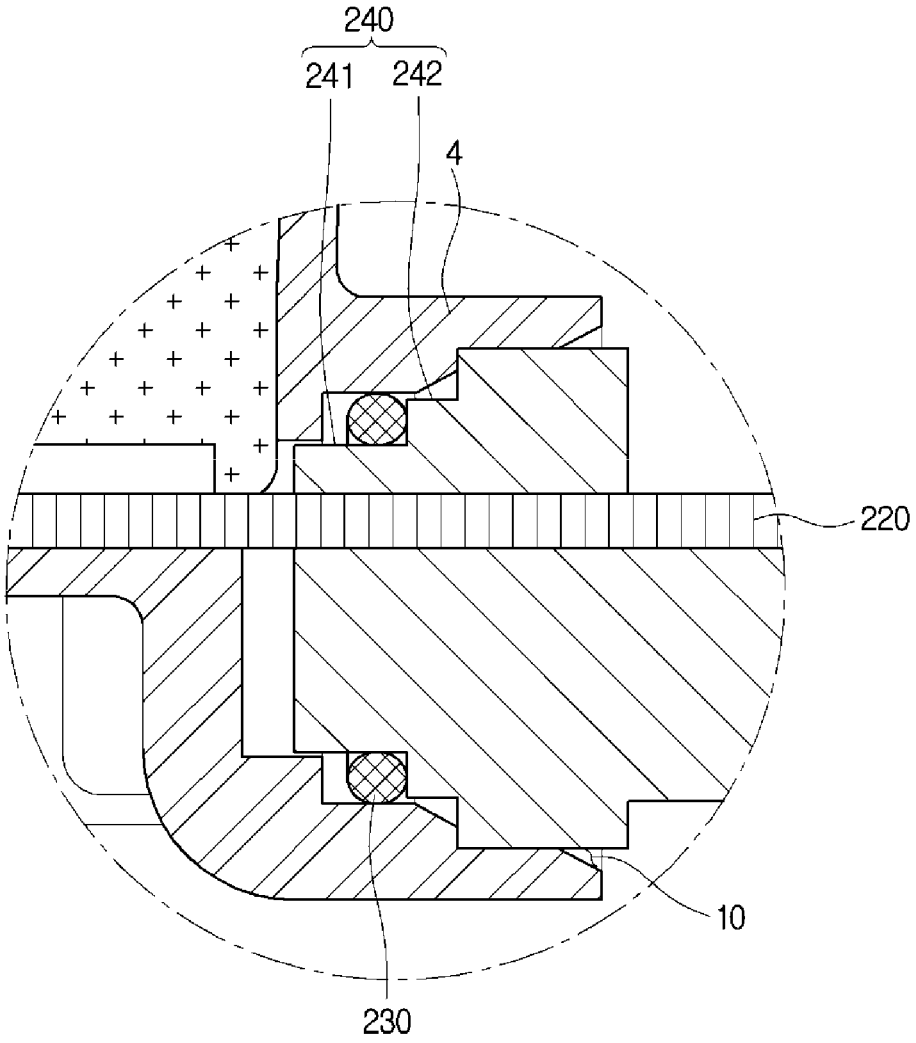
FIG. 5 is an enlarged cross-sectional view illustrating a coupled portion of the electric connector 200 and the housing 1.

FIG. 5 is an enlarged cross-sectional view illustrating a coupled portion of the electric connector 200 and the housing 1.

As illustrated in FIG. 4, the housing 1 of the electric vehicle may be provided, and an inner fixing bolt 3 may be inserted through the first housing connection part 210 and coupled to a corresponding second housing connection part 2 of the housing. The housing 1 may be a portion that includes the inner fixing bolt 3 and is coupled to the electric connector 200.

The inner fixing bolt 3 may electrically and physically connect the housing 1 to the electric connector 200. Particularly, the inner fixing bolt 3 may be coupled to the second housing connection part 2 to prevent the electric connector 200 from being horizontally vibrated.

A connector insertion groove 4 may be defined outside the housing 1. The insertion part 240 of the electric connector 200 may be inserted into the connector insertion groove 4. Thus, the connector insertion groove 4 may have a groove that has the same shape as the insertion part 240.

The coupled portion will be described in more detail with reference to FIG. 5.

The connector insertion groove 4 may be provided as a two-stage groove. Since the connector insertion groove is formed in two stages of grooves, the insertion part 240 may be more easily inserted. Particularly, the connector insertion groove may have a first groove having a relatively large diameter compared to a second groove having a relatively small diameter. In this case, the insertion part 240 may have two-stages as well in the form of a first shaft portion 241 and second shaft portion 242, corresponding to the two stages of the connector insertion groove 4. Since a first shaft portion insertion part 241 having a diameter less than that of the first stage groove of the connector insertion groove 4 and having the same diameter as the second stage groove is inserted first, the electric connector may be easily inserted even though the insertion part 240 is not accurately inserted into the connector insertion groove 4 in the insertion process.

Furthermore, the connector insertion groove 4 may include a mounting induction chamber 10. The mounting induction chamber 10 may be disposed on an edge that contacts the electric connector 200 first to induce the easy mounting of the electric connector 200 together with the two-stage insertion groove.

Particularly, since the mounting induction chamber 10 is provided in a shape in which an outer edge of the connector insertion groove 4 is manufactured in an oblique shape, but an angled shape, a user may easily mount the electric connector 200 when the electric connector 200 is inserted into the insertion groove 4. The mounting induction chamber 10 may have an inclination portion in an inner direction of the connector insertion groove 4. Thus, even though the user does not accurately insert the electric connector 200 into the connector insertion groove 4, the electric connector may be accurately inserted along the mounting induction chamber 10 that is inclined inward.

According to the current embodiment, the bolt fixing part may be omitted to reduce the number of manufacturing process and manufacturing costs when compared to the related art. However, the horizontal vibration that occurs when the bolt fixing part is omitted may be supplemented by using an inner fixing bolt 2 as described above.

Here, the inner fixing bolt 2 may prevent the electric connector 200 from being horizontally vibrated, but do not prevent the electric connector 200 from being vertically vibrated. Thus, designs of the connector insertion groove 4 and insertion part 240 for preventing the electric connector 200 from being vertically vibrated will be described.

In principle, the connector insertion groove 4 and the insertion part 240 have to have the same diameter. When the connector insertion groove 4 and the insertion part 240 have the same diameter, the insertion part 240 may be inserted into the connector insertion groove 4. Thereafter, the insertion part 240 may be closely attached to the connector insertion groove 4 to prevent the electric connector 200 from being separated.

However, when the connection insertion groove 4 and the insertion part 240 have completely the same diameter, if the vibration occurs even though the electric connector 200 is not accurately inserted, the electric vehicle and the electric connector may be separated from each other. Thus, according to the current embodiment, the insertion part 240 has a diameter that is slightly greater than that of the connector insertion groove 4 to prevent the electric connector 200 from being separated in the vertical vibration direction.

Particularly, the insertion part 240 may be manufactured with a diameter that is greater than that of the connector insertion groove 4 so that the insertion part 240 is insertable by the human force. In this case, since the insertion part 240 has a diameter greater than that of the connector insertion groove 4, the insertion part 240 may be press-fitted to prevent the electric connector 200 from being vertically vibrated. In the case in which the insertion part 240 has a diameter greater than that of the connector insertion groove 4, when the insertion part 240 is inserted, the insertion part 240 may be pressed by upper and lower portions of the connector insertion groove 4.

The press-fitting may represent a process in which two parts are press-fitted with respect to each other at a limit gauge. Particularly, a press-fitting process in which a gap occurs between a hole and a shaft may be called clearance fitting, a press-fitting process in which coupling clearance is provided between the hole and the shaft may be called interference fitting, and a press-fitting process in which the clearance fitting and the interference fitting are capable of being performed by tolerance may be called slide fitting.

A degree to which the insertion part 240 has a diameter greater than that of the connector insertion groove 4 may be called "press-fit tolerance". The specific value may refer to the tolerance reference table that is utilized in design fields. In the current embodiment, a tolerance value corresponding to the press-fitting may be used.

In case of the sealing 230, although the sealing 230 is pressed between the connector insertion groove 4 and the insertion part 240 by the bolt in the related art, the fixing using the bolt is provided in the current embodiment. Thus, a device or surface for performing the protection against dusts or watertightness which is an original function of the sealing 230 may be required.

As described above, although the sealing 230 is disposed between the connector insertion groove 4 and the insertion part 240 in principle, the sealing according to the current embodiment may be disposed on the shaft of the insertion part 240 in a circumferential direction as illustrated in FIG. 5. Thus, when the insertion part 240 is inserted into the connector insertion groove 4, the sealing 230 is disposed on the shaft in the circumferential direction may be pressed to match the spaced space.

Particularly, the deformable sealing 230 having the circular shape is deformed in the same shape as the space between the insertion groove 4 and the insertion part 240 to naturally fill the gap between the connector insertion groove 4 and the insertion part 240.

That is to say, a pressure generated by the press-fitting between the insertion groove 4 and the insertion part 240 in the above-described press-fit tolerance may press the sealing 230 to allow the sealing 230 to be filled into the gap between the connector insertion groove 4 and the insertion part 240. As a result, the sealing 230 may be fixed between the connector insertion groove 4 and the insertion part 240 without using the bolt.

In the above-described electric connector, the embodiments set forth therein are not so limitedly, but all or part of the embodiments can be selectively combined so as to derive many variations.

The electric connector that is applied to the power conversion device for the electric vehicle according to the embodiment may have the simple mounting structure to reduce the assembly costs.

Also, the electric connector according to the embodiment may have the simple mounting structure and the stable sealing function.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric connector configured to electrically connect a housing of electric equipment to a power device, the electric connector comprising:

a connection bar disposed at a first end of the electric connector;

a first housing connection portion defined by an opening passing through the connection bar, wherein the first housing connection portion is configured to accommodate an inner fixing bolt of the housing such that the first housing connection portion is electrically connected to a corresponding second housing connection portion of the housing;

an insertion part connected to the connection bar and configured to engage with an insertion groove of the housing;

a sealing disposed along a circumference of a shaft of the insertion part; and a power device connection portion disposed at a second end of the electric connector and configured to be inserted into the electric equipment and electrically connect to the electric equipment;

wherein the inner fixing bolt of the housing is configured to electrically connect the power device to the electric connector, and wherein a diameter of the shaft of the insertion part is greater than a diameter of an insertion groove of the electric equipment, and a difference between the diameters is within a tolerance value to allow the insertion part to be press fitted to the insertion groove.

2. The electric connector according to claim 1, wherein the shaft of the insertion part comprises a first shaft portion and a second shaft portion having different diameters.

3. The electric connector according to claim 2, wherein the shaft is configured in a circular shape or a rectangular shape with a rounded edge.

* * * * *